US011889930B1

(12) United States Patent
Bastien et al.

(10) Patent No.: US 11,889,930 B1
(45) Date of Patent: Feb. 6, 2024

(54) FOLDABLE CHILD SEAT

(71) Applicant: MONAHAN PRODUCTS, LLC, Rockland, MA (US)

(72) Inventors: Richard M. Bastien, Cumberland, RI (US); Eric Howard Perlman, Weymouth, MA (US); Meghan Kathleen O'Donovan, Boston, MA (US)

(73) Assignee: MONAHAN PRODUCTS, LLC, Rockland, MA (US)

( * ) Notice: Subject to any disclaimer, the term of this patent is extended or adjusted under 35 U.S.C. 154(b) by 0 days.

(21) Appl. No.: 18/061,599

(22) Filed: Dec. 5, 2022

(51) Int. Cl.
*A47D 1/02* (2006.01)
*A47D 13/10* (2006.01)
*A47D 1/08* (2006.01)

(52) U.S. Cl.
CPC ..... *A47D 1/02* (2013.01); *A47D 13/107* (2013.01); *A47D 1/08* (2013.01)

(58) Field of Classification Search
CPC ..... A47D 13/107; A47D 13/101; A47D 1/08; A47D 1/02
See application file for complete search history.

(56) References Cited

U.S. PATENT DOCUMENTS

| | | | |
|---|---|---|---|
| 4,553,786 | A | 11/1985 | Lockett, III et al. |
| D321,599 | S | 11/1991 | Takahashi et al. |
| 5,172,955 | A | 12/1992 | Freese et al. |
| 5,269,591 | A | 12/1993 | Miga, Jr. et al. |
| 5,451,095 | A | 9/1995 | Riback |
| D440,412 | S | 4/2001 | Huang |
| 6,851,745 | B2 | 2/2005 | nee Wilkins et al. |
| 6,877,802 | B2 | 4/2005 | Christensen et al. |
| D560,374 | S | 1/2008 | Bergkvist |
| 7,779,490 | B2 | 8/2010 | Bergkvist |
| 7,780,236 | B2 | 8/2010 | Bergkvist |
| 8,079,639 | B2 | 12/2011 | Zeng et al. |
| D692,680 | S | 11/2013 | Bergkvist et al. |
| 8,893,326 | B2 | 11/2014 | Gooris |
| D737,061 | S | 8/2015 | Daley et al. |
| 9,095,228 | B2 | 8/2015 | Gooris |
| D773,838 | S | 12/2016 | Ejvinsson et al. |
| D799,837 | S | 10/2017 | Wanders |
| 9,848,715 | B2 | 12/2017 | Soriano |
| D832,602 | S | 11/2018 | Elmberg et al. |
| 10,327,566 | B2 | 6/2019 | Mountz |
| D863,794 | S | 10/2019 | Holleis et al. |
| 2011/0127810 | A1 | 6/2011 | Lee et al. |

(Continued)

FOREIGN PATENT DOCUMENTS

| | | | |
|---|---|---|---|
| AU | 2007270099 | B2 | 9/2010 |
| AU | 2007270098 | B2 | 2/2011 |

(Continued)

*Primary Examiner* — Milton Nelson, Jr.
(74) *Attorney, Agent, or Firm* — Lando & Anastasi, LLP

(57) ABSTRACT

A foldable child seat is disclosed. The child seat includes a frame for supporting a flexible material having a middle bar, a base having at least one cross bar, a reclining mechanism having a plurality of grooves for engaging with the middle bar, and an operating lever to actuate the reclining mechanism. The reclining mechanism comprises a locking mechanism for locking the middle bar in at least one of the grooves. The reclining mechanism comprises a portion fixed between two cross bars.

14 Claims, 15 Drawing Sheets

(56) References Cited

U.S. PATENT DOCUMENTS

| | | | |
|---|---|---|---|
| 2014/0366276 | A1 | 12/2014 | Chang et al. |
| 2016/0157633 | A1 | 6/2016 | Aboukrat et al. |

FOREIGN PATENT DOCUMENTS

| | | | | | |
|---|---|---|---|---|---|
| CA | 2654690 | C | | 5/2014 | |
| CA | 2654691 | C | | 5/2014 | |
| CN | 101489445 | B | | 3/2011 | |
| CN | 101489446 | B | | 6/2011 | |
| CN | 203314544 | U | | 12/2013 | |
| CN | 107669022 | A | * | 2/2018 | ..... A47D 1/002 |
| CN | 208837438 | U | | 5/2019 | |
| EP | 2037778 | B1 | | 3/2010 | |
| ES | 2343215 | T3 | | 7/2010 | |
| FR | 3039048 | B1 | | 3/2018 | |
| IL | 196218 | | | 1/2008 | |
| JP | 5113167 | B2 | | 1/2013 | |
| JP | 5123298 | B2 | | 1/2013 | |
| JP | 2016041200 | A | * | 3/2016 | |
| JP | 6363427 | B2 | | 7/2018 | |
| KR | 101320181 | B1 | | 10/2013 | |
| KR | 101320807 | B1 | | 10/2013 | |
| SE | 530117 | C2 | | 3/2008 | |
| SE | 530118 | C2 | | 3/2008 | |
| WO | 2008004958 | A1 | | 1/2008 | |
| WO | 2008004959 | A1 | | 1/2008 | |
| WO | 2016144242 | A1 | | 9/2016 | |

* cited by examiner

FOLDABLE CHILD SEAT

FIELD OF TECHNOLOGY

Aspects and embodiments of the disclosure are directed generally to a foldable child seat. In particular, aspects and embodiments of the disclosure are directed to a foldable child seat having a reclining mechanism.

SUMMARY

In accordance with one aspect, there is provided a foldable child seat. The foldable child seat may comprise a frame for supporting a flexible material. The frame may comprise a first frame side bar attached to a middle bar. The foldable child seat may comprise a base comprising a first base side bar, a second base side bar, a first cross bar connected to the first base side bar and the second base side bar, and a second cross bar connected to the first base side bar and the second base side bar. The foldable child seat may comprise a reclining mechanism comprising a portion fixed between the first cross bar and the second cross bar. The reclining mechanism may include at least two grooves configured to engage with the middle bar. The reclining mechanism may include a locking mechanism configured to lock the middle bar in at least one of the two grooves. The foldable child seat may comprise an operating lever operably connected to actuate the reclining mechanism.

In some embodiments, the reclining mechanism is coupled to the first cross bar and to the second cross bar.

In some embodiments, the reclining mechanism includes a housing comprising a first joint configured to engage with the first cross bar and a second joint configured to engage with the second cross bar. The reclining mechanism may comprise a positioner contained within the housing comprising the at least two grooves.

In some embodiments, the operating lever is operably connected to pivot or slide the positioner.

In some embodiments, the operating lever is contained within the housing and accessible to a user by an opening in the housing.

In some embodiments, the reclining mechanism comprises at least three grooves.

In some embodiments, the reclining mechanism comprises a safety locking mechanism configured to prevent the middle bar from engaging with a groove associated with a collapsed orientation of the child seat.

In some embodiments, the safety locking mechanism comprises a latch.

In some embodiments, the safety locking mechanism is operably connected to lock the operating lever into a position that prevents the middle bar from engaging with the groove associated with the collapsed orientation of the child seat.

In accordance with one aspect, there is provided a foldable child seat. The foldable child seat may comprise a frame for supporting a flexible material. The frame may comprise a first frame side bar attached to a frame foot bar, and a middle bar attached to the frame foot bar. The foldable child seat may comprise a base comprising a first base side bar, a second base side bar, a first cross bar connected to the first base side bar and the second base side bar, and a second cross bar connected to the first base side bar and the second base side bar. The foldable child seat may comprise a reclining mechanism comprising a portion fixed between the first cross bar and the second cross bar. The reclining mechanism may include at least two grooves configured to engage with the middle bar, one groove being associated with a collapsed orientation of the child seat. The reclining mechanism may comprise a safety locking mechanism configured to prevent the middle bar from engaging with the groove associated with the collapsed orientation of the child seat. The foldable child seat may comprise an operating lever operably connected to actuate the reclining mechanism.

In some embodiments, the reclining mechanism comprises a locking mechanism configured to lock the reclining mechanism in at least one of the two grooves.

In some embodiments, the operating lever is positioned adjacent a base foot bar of the base.

In some embodiments, the reclining mechanism comprises a housing having a joint configured to engage with the cross bar and a channel, and a spring-loaded positioner comprising the at least two grooves contained within the housing, the middle bar configured to engage with the at least two grooves through the channel.

In some embodiments, the safety locking mechanism is configured to prevent the middle bar from being driven through the channel into a position associated with the collapsed orientation of the child seat.

In accordance with one aspect, there is provided a foldable child seat. The foldable child seat may comprise a frame for supporting a flexible material. The frame may comprise a first frame side bar attached to a frame foot bar, and a middle bar attached to the frame foot bar. The foldable child seat may comprise a base comprising a first base side bar, a second base side bar, and a cross bar connected to the first base side bar and the second base side bar. The foldable child seat may comprise a reclining mechanism comprising a housing having a joint fixed to the cross bar and a spring-loaded positioner including at least three grooves configured to engage with the middle bar. The foldable child seat may comprise an operating lever operably connected to actuate the reclining mechanism.

In some embodiments, the reclining mechanism comprises a locking mechanism configured to lock the middle bar in at least one of the three grooves.

In some embodiments, the housing comprises a channel. The middle bar may be configured to engage with the at least three grooves through the channel.

In some embodiments, one groove is associated with a collapsed orientation of the child seat.

In some embodiments, the reclining mechanism further comprises a safety locking mechanism configured to prevent the middle bar from engaging with the groove associated with the collapsed orientation of the child seat.

In some embodiments, the safety locking mechanism comprises a latch configured to prevent the middle bar from engaging the groove associated with the collapsed orientation of the child seat.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The disclosure relates generally to a foldable child seat. The child seat may include a flexible material for supporting a child. In use, a parent or caregiver may position the child on a seating surface of the flexible material that provides for the child to be supported in a comfortable position. The child seat may be configurable to support the child in one or more of a variety of orientations, including one or more upright or semi-upright orientations and one or more reclined or intermediate orientations. The child seat may additionally be foldable into a substantially collapsed orientation for travel or storage.

The child seat disclosed herein may be fitted to support children at various developmental stages, including a newborn, infant, toddler, preschooler, or school-age child. In certain embodiments, the child seat may include one or more inserts to secure the child, such as a padded pillow (optionally including head, neck, and/or body support), safety harness, or seat belt. The insert may be designed to provide appropriate support for a child of the target developmental stage. The child seat may include one or more attachment mechanisms for accessories, such as a toy bar, tray table, hand rest, or footrest.

Figure 1A:
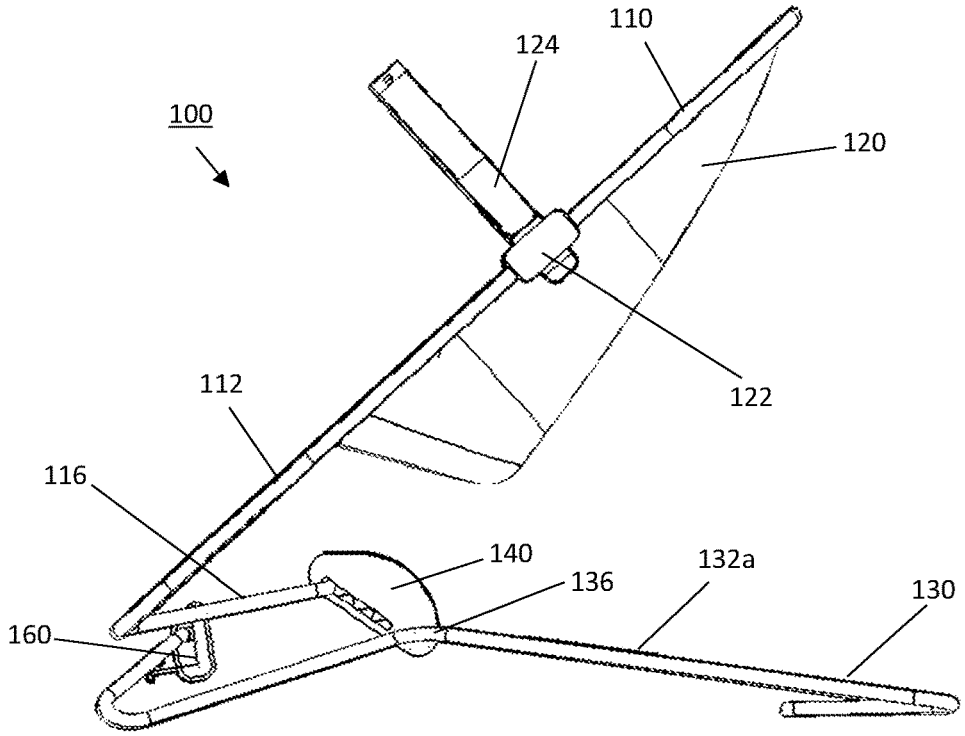
FIG. 1A is a side view of a foldable child seat, according to one embodiment.
Figure 1B:
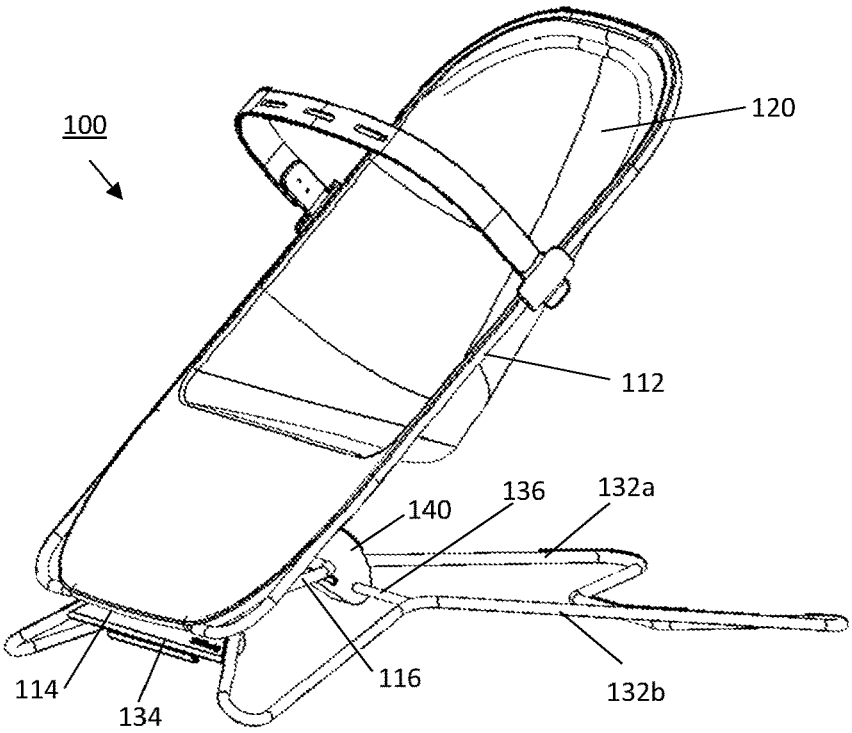
FIG. 1B is a side perspective view of a foldable child seat, according to one embodiment.

One exemplary foldable child seat 100 is shown generally in FIGS. 1A-1B. The child seat 100 may include a frame 110 for supporting a flexible material 120. The frame 110 may comprise at least one frame side bar 112, at least one frame foot bar 114, and a middle bar 116. The at least one frame side bar 112 and at least one frame foot bar 114 may generally define a substantially enclosed area for supporting the flexible material 120, referred to herein as the support area. Thus, the at least one side bar 112 and at least one foot bar 114 may be dimensioned to provide a support area for the flexible material, for example, a support area dimensioned to provide seating for a child of the target developmental stage.

The support area may be circular, oval, rectangular, or other shape. For simplicity, the support area is described as having four sides. However, it should be understood that rounded corners, circular, oval, and other shaped areas are within the scope of the disclosure. The foot bar 114 may define a first end of the support area. The frame may comprise a continuous or semi-continuous side bar 112 defining an opposite end of the support area or more than one side bar defining any remaining sides of the support area. The middle bar 116 may extend backwards from a distal end of the side bar 112, forming a pivot point on the frame 110 for movement of the support area as driven by movement of the middle bar 116. The middle bar 116 may comprise a portion oriented substantially parallel to the foot bar 114. The portion of the middle bar 116 may be configured to engage with the reclining mechanism 140, as discussed in more detail below.

The pivot point may form an angle between the side bar 112 and backward extending portion of the middle bar 116, as shown in FIG. 1A. In general, the length of the frame side bar 112 may define a support area dimensioned to support a child of the target developmental stage. The length of the backward extending portion of middle bar 116 may be dimensioned to meet or engage with the reclining mechanism 140. The angle formed between frame side bar 112 and backward extending portion of middle bar 116 may be between about 10°-80°, for example, 10°-20°, 15°-30°, 30°-45°, 45°-60°, 60°-75°, or 70°-80° or about 10°, 15°, 30°, 45°, 60°, 75°, or 80°. A ratio may be defined between the length of the frame side bar 112 ($L_{SA}$) and the backward extending portion of the middle bar 116 ($L_{MB}$) ($L_{SA}$:$L_{MB}$). In some embodiments $L_{SA}$:$L_{MB}$ is 1:0.1-1:0.5, for example, 1:0.1-1:0.2, 1:0.2-1:0.3, or 1:0.3-1:0.5, or about 1:0.1, 1:0.15, 1:0.2, 1:0.25, 1:0.3, 1:0.35, 1:0.4, 1:0.45, or 1:0.5. The angle and/or ratio between side bar 112 and the backward extending portion of middle bar 116 may be selected to enable the various child seat orientations (e.g., one or more upright or semi-upright orientations, one or more reclined or intermediate orientations, and a collapsed orientation) upon efficient actuation of the reclining mechanism.

The frame may be formed of a substantially continuous structure, for example, a solid structure or a tubular structure. In some embodiments, the frame is formed of a plurality of modular structures. The modular structures may have ends configured to mate for forming the substantially continuous structure. The frame may be formed of a structural material capable of support the weight of a child of the target developmental stage during motion. The frame material may be water resistant, for example, resistant to corrosion. The frame components may each be independently formed of a metal or a polymer. The metal may be, for example, titanium, iron, chromium, nickel, aluminum, copper, molybdenum, combinations thereof, and alloys thereof. One exemplary metal material is stainless steel. The polymer may be, for example, acrylonitrile butadiene styrene (ABS), acrylonitrile styrene acrylate (ASA), polylactic acid (PLA), polyvinyl chloride (PVC), polyethylene terephthalate (PET), polyethylene terephthalate glycol (PETG), polycarbonate (PC), polypropylene (PP), nylon, polyether ether ketone (PEEK), polyether ketone ketone (PEKK), polyaryl ether ketone (PAEK), polyetherimide (PEI), combinations thereof, composites thereof, and hybrids thereof. The frame components may be manufactured, for example, by extrusion or additive manufacturing (such as 3D printing).

The child seat 100 may include a flexible material 120 supported by the frame 110. The child seat 100 may include an attachment mechanism 122 for an accessory 124, such as a toy bar. The flexible material 120 may extend to cover or substantially cover the support area. In some embodiments, a portion of the flexible material 120 may overhang at least one of the side bar 112 and the foot bar 114. The flexible material 120 may have a concave, for example, ergonomic, configuration to cradle the child in a comfortable position. In some embodiments, the flexible material 120 is designed to cradle the child in a laying or semi-laying position. In some embodiments, the flexible material 120 is designed to cradle the child in a seated or semi-seated position. The flexible material 120 may be removable from the frame 110, for example, for washing. The flexible material 120 may be designed to support a child of up to 35 lbs., for example, up to 30 lbs., up to 25 lbs., or up to 20 lbs.

The flexible material may be formed of a material selected to provide comfortable support to the child. The flexible material may be a textile material. Exemplary textile materials include cotton, wool, synthetic fibers, such as, nylon, polyester, acrylic, rayon, spandex, etc., and combinations or blends thereof. The flexible material may be a breathable textile. The flexible material may be a cozy textile. In some embodiments, the flexible material may be a mesh fabric. In some embodiments, the flexible material may be quilted and/or contain a padded surface. The flexible material may be washable and/or fast drying. In some embodiments, the flexible material may be water resistant or water repellant.

The child seat may include a base 130. The base 130 may support the foldable child seat 100 on a surface, such as the ground surface or a table. The base may include one or more base side bars 132*a*, 132*b* and a cross bar 136 connected to side bars 132*a*, 132*b*. The base may include a support bar 134, also referred to as a base foot bar herein, extending between base side bars 132*a*, 132*b*.

The cross bar 136 may extend between side bars 132*a*, 132*b*. The cross bar 136 may be configured to engage with the reclining mechanism 140, described in more detail below. The cross bar 136 may be positioned in the vicinity of the middle bar 116, such that the cross bar 136 and middle bar 116 engage with the reclining mechanism 140. In some embodiments, the cross bar 136 is positioned at a midpoint of the side bars 132*a*, 132*b* (for example, as shown in FIGS. 1A-1B). In some embodiments, cross bar 136 is positioned at a distal end of side bars 132*a*, 132*b* (for example, cross bar 236*a* as shown in FIGS. 2A-2B).

The side bars 132*a*, 132*b* may be dimensioned (for example, have a length selected) to provide stability to the foldable child seat 100, for example, while bouncing, rocking, or vibrating. The side bars 132*a*, 132*b* may have inclines to position cross bar 136 elevated from the surface supporting the base, for example, to accommodate the reclining mechanism 140. Thus, in some embodiments, the side bars 132*a*, 132*b* may be described as having a dimension defining a footprint area of the child seat 100, as shown in FIG. 1B. A ratio may be defined between a length of the frame side bar 112 ($L_{SA}$) and a length of the footprint ($L_F$) of the base, as defined by the dimensions of side bars 132*a*, 132*b* ($L_{SA}$:$L_F$). In some embodiments $L_{SA}$:$L_F$ is 1:0.2-1:1, for example, 1:0.2-1:0.3, 1:0.3-1:0.4, or 1:0.4-1:0.5, 1:0.5-1:0.8, 1:0.8-1:1, or about 1:0.2, 1:0.3, 1:0.4, 1:0.5, 1:0.6, 1:0.7, 1:0.8, 1:0.9, or 1:1. The ratio between the length of the frame side bar 112 and the length of the footprint of the base, as defined by side bars 132*a*, 132*b*, may be selected to provide stability to the child seat 100, for example, while bouncing, rocking, or vibrating. The support bar 134 may provide stability to the child seat 100. In some embodiments, the side bars 132*a*, 132*b* may include a grip or non-slip surface on a bottom facing side.

The base may be formed of a substantially continuous structure, for example, a solid structure or a tubular structure. In some embodiments, the base is formed of a plurality of modular structures. The modular structures may have ends configured to mate for forming the substantially continuous structure. The base may be formed of a structural material capable of support the weight of a child of the target developmental stage during motion. The base material may be water resistant, for example, resistant to corrosion. The base components may each be independently formed of a metal or a polymer. The metal may be, for example, titanium, iron, chromium, nickel, aluminum, copper, molybdenum, combinations thereof, and alloys thereof. One exemplary metal material is stainless steel. The polymer may be, for example, acrylonitrile butadiene styrene (ABS), acrylonitrile styrene acrylate (ASA), polylactic acid (PLA), polyvinyl chloride (PVC), polyethylene terephthalate (PET), polyethylene terephthalate glycol (PETG), polycarbonate (PC), polypropylene (PP), nylon, polyether ether ketone (PEEK), polyether ketone ketone (PEKK), polyaryl ether ketone (PAEK), polyetherimide (PEI), combinations thereof, composites thereof, and hybrids thereof. The base components may be manufactured, for example, by extrusion or additive manufacturing (such as 3D printing).

Figure 2A:
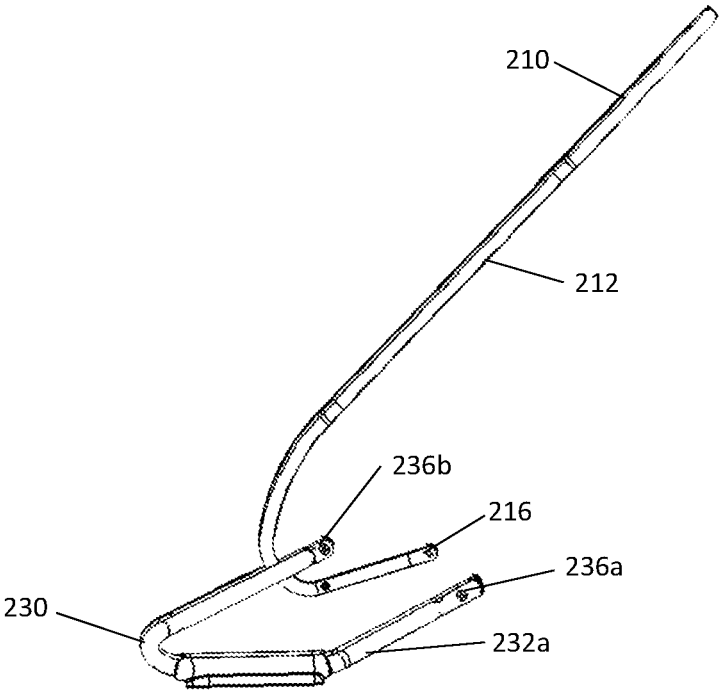
FIG. 2A is a side view of certain components of a foldable child seat, according to one embodiment.
Figure 2B:
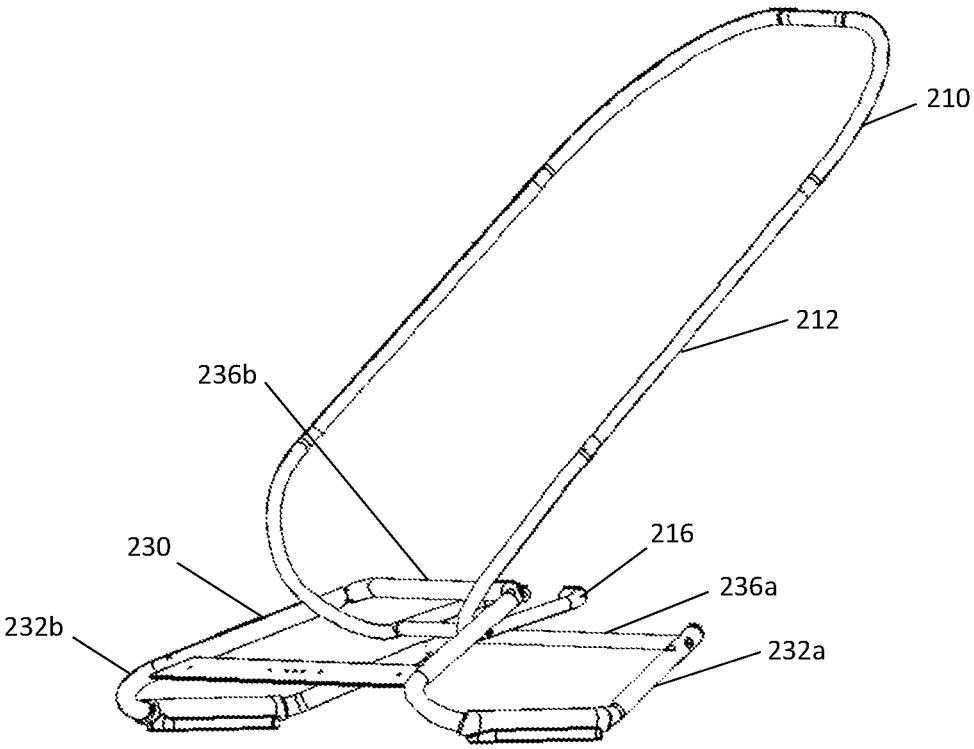
FIG. 2B is a side perspective view of certain components of a foldable child seat, according to one embodiment.
Figure 2C:
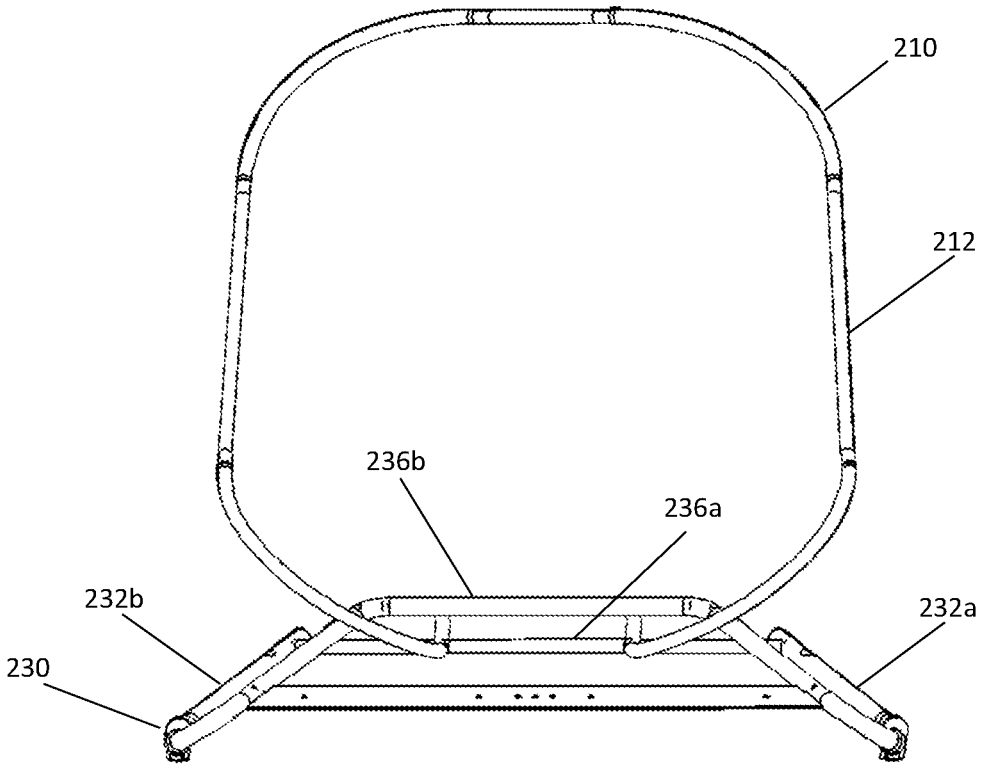
FIG. 2C is a front view of certain components of a foldable child seat, according to one embodiment.

Another exemplary frame 210 and base 230 construction is shown in FIGS. 2A-2C. For simplicity, other components (such as the flexible material and reclining mechanism) are omitted from FIGS. 2A-2C. Frame 210 includes side bar 212 and middle bar 216. Base 230 includes side bars 232*a*, 232*b* and first and second cross bars 236*a*, 236*b*. Second cross bar 236*b* may be positioned at a distal end of side bars 232*a*, 232*b*, opposite cross bar 236*a*. Second cross bar 236*b* may provide a pivot point for frame 210. The reclining mechanism may be fixed between cross bars 236*a*, 236*b* and configured to engage with middle bar 216.

The child seat 100 may include a reclining mechanism 140. Exemplary reclining mechanisms are shown in FIGS. 3A-6B (as reference numerals 340, 440, and 540). The reclining mechanism may include a housing. The reclining mechanism may include a plurality of grooves and a channel configured to engage with the middle bar. The channel may be an elongated opening of the housing configured to allow the middle bar to pass therethrough. In some embodiments, the channel may be a track for the middle bar. The plurality of grooves may engage with the middle bar within the channel. In some embodiments, the plurality of grooves are incorporated in the track of the channel. In some embodiments, the plurality of grooves are defined by a groove plate. The groove plate may pivot to engage the middle bar with each of the grooves. The reclining mechanism may comprise a joint configured to receive the cross bar. The joint may be an opening in the housing configured to allow the cross bar to pass therethrough. In some embodiments, the reclining mechanism may be fixed to the cross bar. In other embodiments, the reclining mechanism may rotate about the cross bar.

The reclining mechanism may include a plurality of grooves configured to engage with the middle bar to position the child seat in a desired orientation. In some embodiments, the reclining mechanism may include at least three grooves configured to position the child seat in an upright or semi-upright orientation, a reclined or intermediate orientation, and a collapsed orientation. In some embodiments, the reclining mechanism may include at least four grooves configured to position the child seat in the upright or semi-upright orientation, a first reclined or intermediate orientation, a second reclined or intermediate orientation, and the collapsed orientation.

One or more component of the reclining mechanism may be independently formed of a metal or a polymer. The metal may be, for example, titanium, iron, chromium, nickel, aluminum, copper, molybdenum, combinations thereof, and alloys thereof. One exemplary metal material is stainless steel. The polymer may be, for example, acrylonitrile butadiene styrene (ABS), acrylonitrile styrene acrylate (ASA), polylactic acid (PLA), polyvinyl chloride (PVC), polyethylene terephthalate (PET), polyethylene terephthalate glycol (PETG), polycarbonate (PC), polypropylene (PP), nylon, polyether ether ketone (PEEK), polyether ketone ketone (PEKK), polyaryl ether ketone (PAEK), polyetherimide (PEI), combinations thereof, composites thereof, and hybrids thereof. The base components may be manufactured, for example, by extrusion or additive manufacturing (such as 3D printing).

Figure 3A:
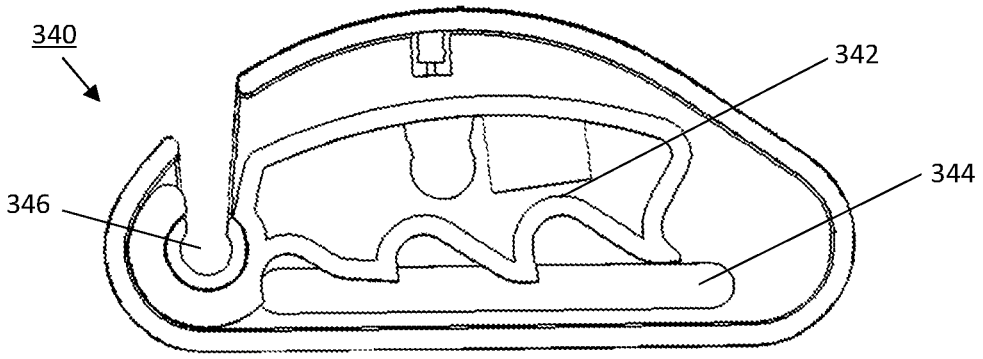
FIG. 3A is a schematic drawing of a reclining mechanism, in accordance with one embodiment.
Figure 3B:
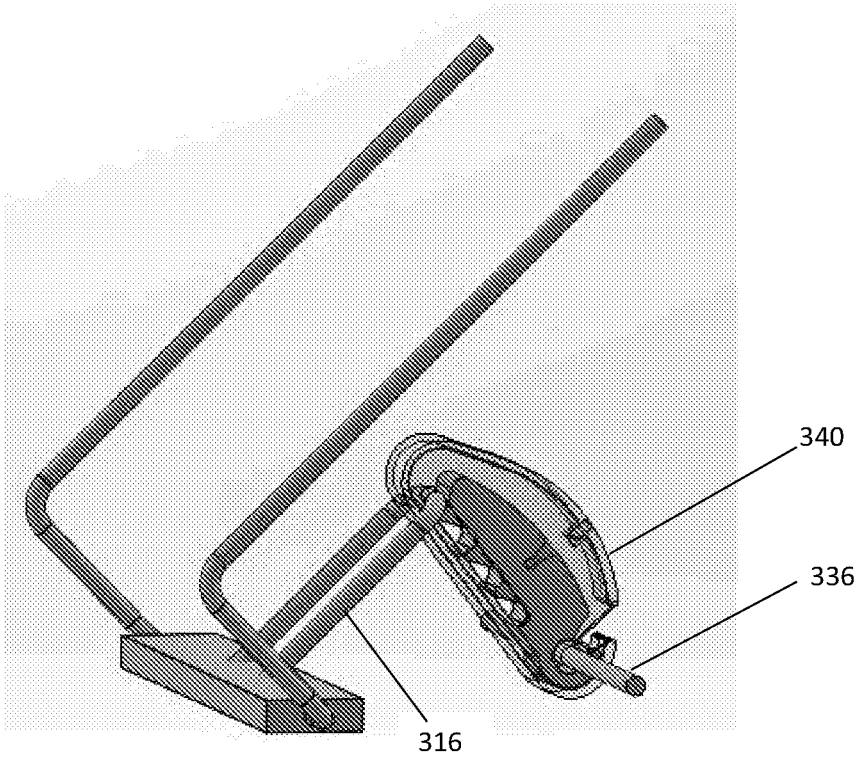
FIG. 3B is a partial view of a foldable child seat having the reclining mechanism of FIG. 3A.

One exemplary reclining mechanism 340 is shown in FIG. 3A and assembled in a partial view of the child seat in FIG. 3B. Reclining mechanism 340 includes grooves 342 configured to engage with middle bar 316 as middle bar 316 is driven along channel 344. Reclining mechanism 340 includes joint 346 configured to receive cross bar 336. In the embodiment of FIGS. 3A-3B, reclining mechanism 340 is configured to rotate about cross bar 336 to drive middle bar 316 along channel 344. When middle bar 316 is engaged with groove 342 closest to joint 346, the child seat may be in the most upright orientation. When middle bar 316 is engaged with groove 342 farthest from joint 346, the child seat may be in the collapsed orientation.

Figure 4A:
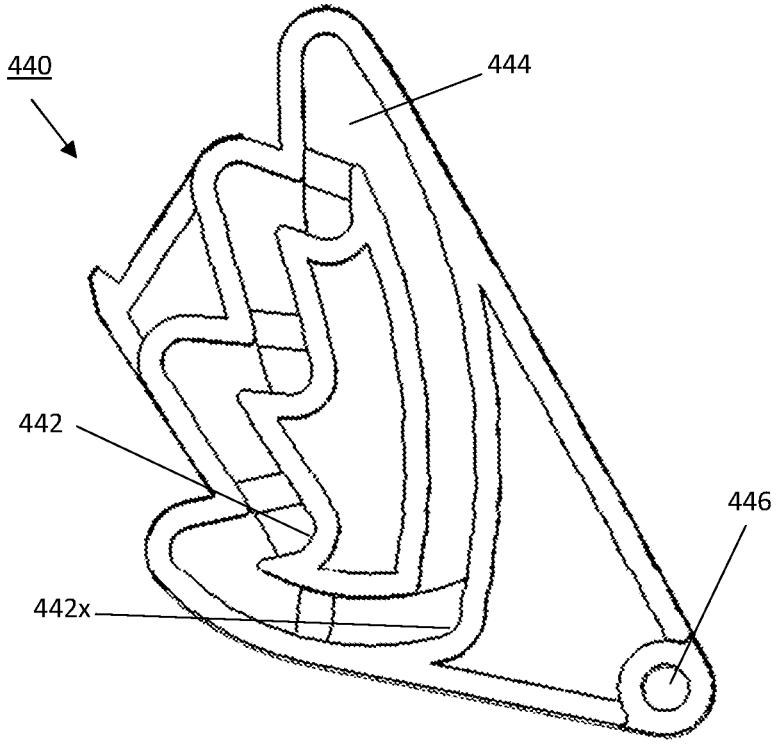
FIG. 4A is a schematic drawing of a reclining mechanism, in accordance with one embodiment.
Figure 4B:
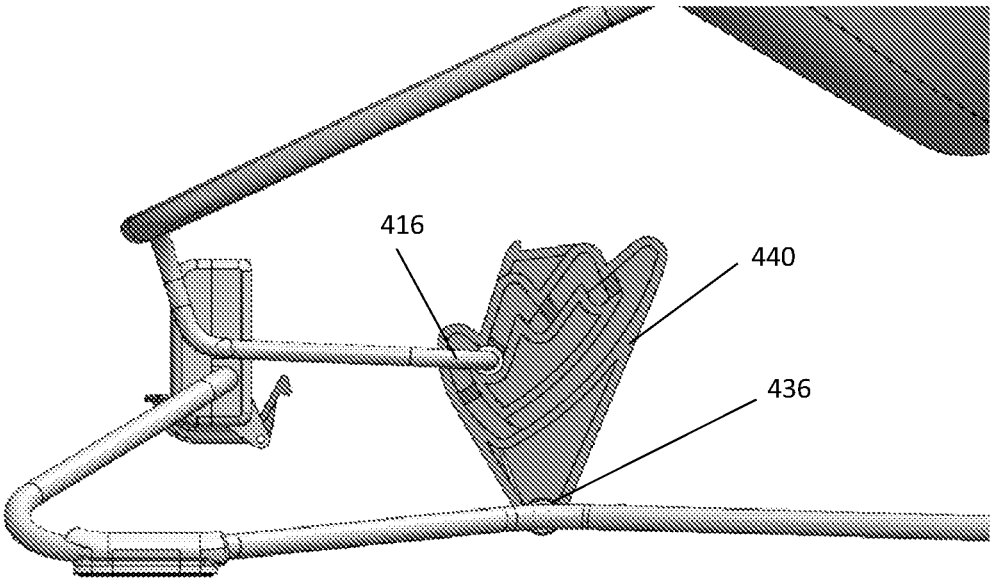
FIG. 4B is a partial view of a foldable child seat having the reclining mechanism of FIG. 4A.

Another exemplary reclining mechanism 440 is shown in FIG. 4A and assembled in a partial view of the child seat in FIG. 4B. Reclining mechanism 440 includes grooves 442 configured to engage with middle bar 416 as middle bar 416 is driven along channel 444. Reclining mechanism 440 includes joint 446 configured to receive cross bar 436. In the embodiment of FIGS. 4A-4B, reclining mechanism 440 is configured to rotate about cross bar 436 to drive middle bar 416 along channel 444. When the middle bar 416 is engaged with groove 442 closest to joint 446, the child seat may be in the most reclined orientation. When the middle bar 416 is engaged with groove 442 farthest from joint 446, the child seat may be in the most upright orientation. When the middle bar 416 is engaged with lower portion of channel 444 (labeled 442*x*), the child seat may be in the collapsed orientation.

The reclining mechanism may rotate about the cross bar in a clockwise direction. The reclining mechanism may rotate about the cross bar in a counterclockwise direction. The rotation may be a partial rotation about the cross bar and need not be a full rotation. For instance, the assembly may allow a rotation of up to about 360°, 330°, 300°, 270°, 240°, 210°, 180°, 150°, 120°, 90°, 60°, or 30°.

Figure 5A:
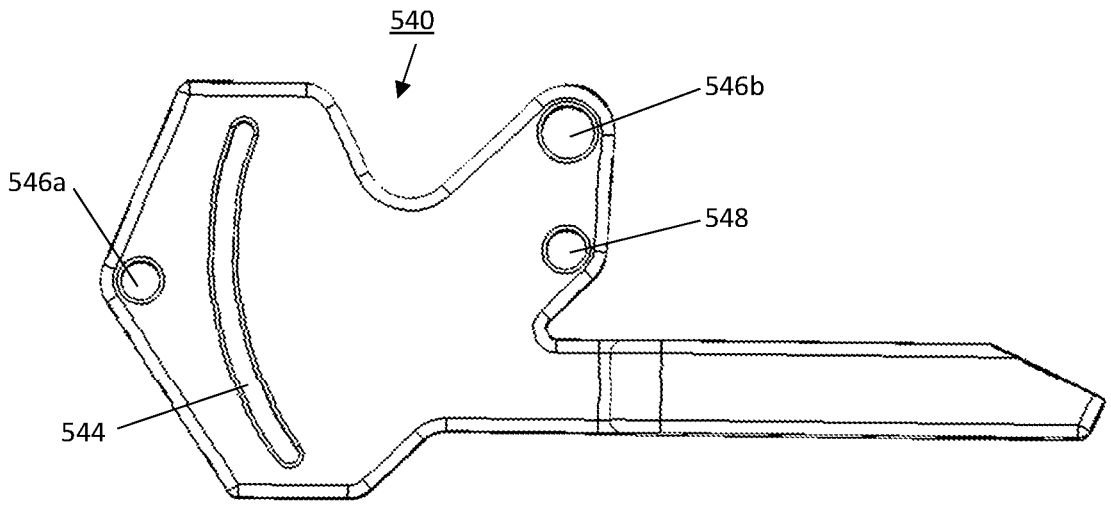
FIG. 5A is a schematic drawing of a reclining mechanism, in accordance with one embodiment.
Figure 5B:
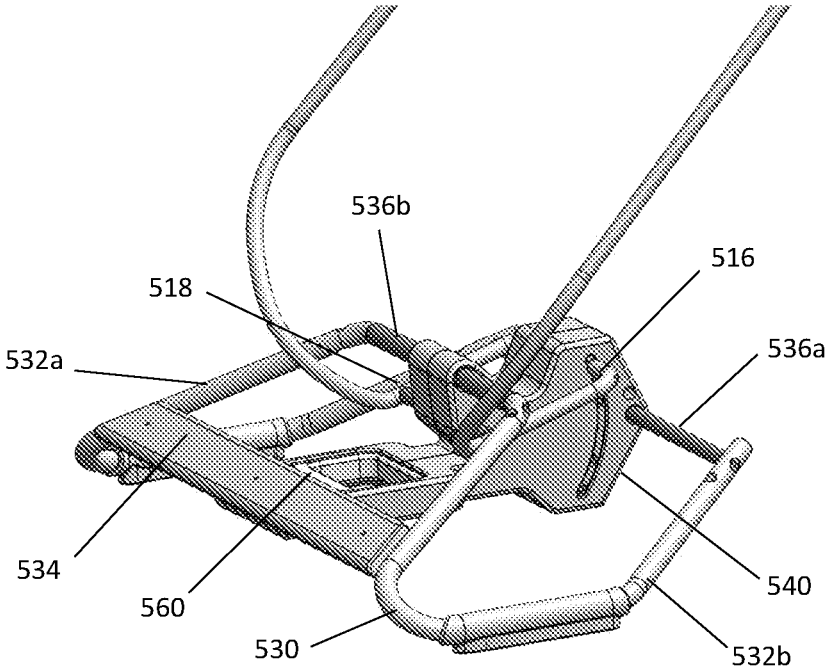
FIGS. 5B-5D are partial views of a foldable child seat having the reclining mechanism of FIG. 5A.
Figure 5C:
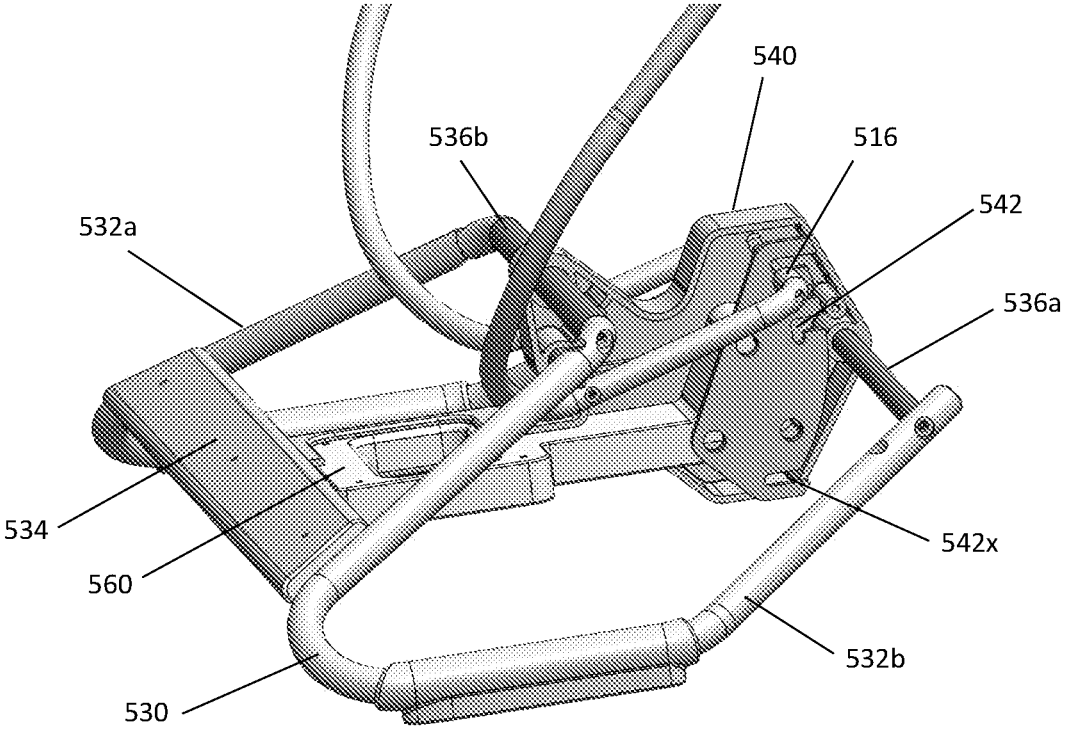
Figure 5D:
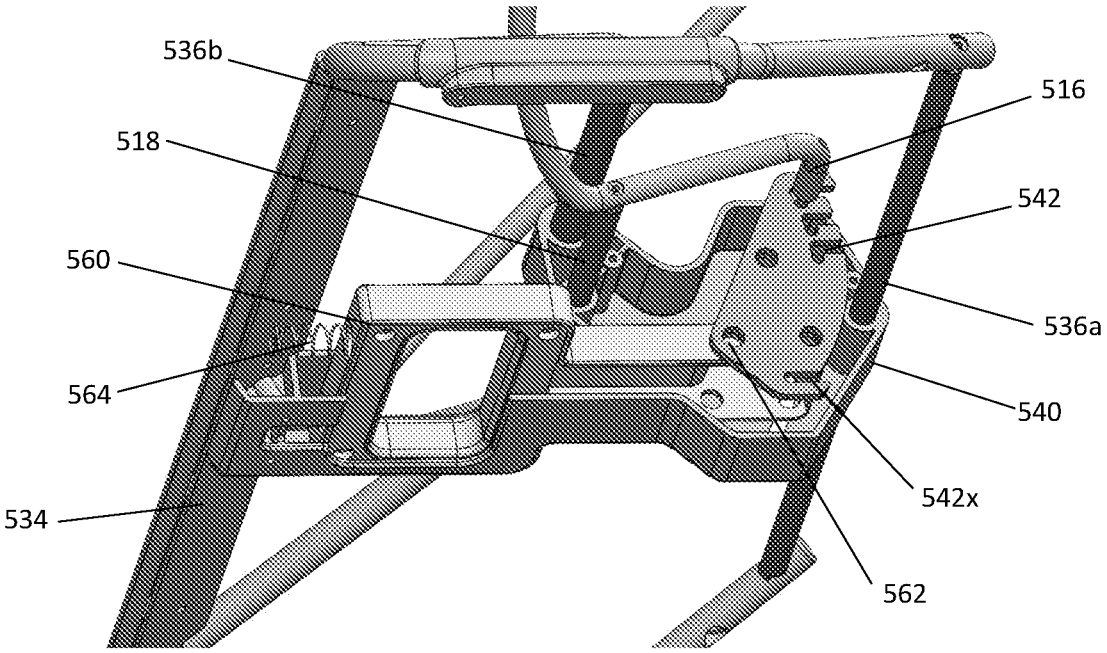

Another exemplary reclining mechanism 540 is shown in FIG. 5A and assembled in a partial view of the child seat in FIGS. 5B-5D. FIG. 5A is a side view showing a housing of reclining mechanism 540. FIGS. 5C-5D are cutout views showing interior components of reclining mechanism 540 positioned within the housing, including operating lever 560 and a groove plate containing grooves 542. Reclining mechanism 540 includes channel 544. Middle bar 516 is configured to engage with grooves 542 through channel 544. Reclining mechanism 540 comprises a portion configured to be fixed between first cross bar 536*a* and second cross bar 536*b*, each of which extends between first side bar 532*a* and second side bar 532*b* of frame 530, as shown in FIG. 5B. First joint 546*a* is configured to engage with first cross bar 536*a*. Second joint 546*b* is configured to engage with second cross bar 536*b*. In the exemplary embodiment of FIGS. 5B-5C, each of side bar 532*a* and 532*b* are curved on both ends to elevate cross bars 536*a* and 536*b*. However, the side bar may be substantially straight or curved on one or both ends to elevate one or both cross bars.

Reclining mechanism 540 comprises a portion configured to extend beyond cross bar 536*a* defining operating lever 560, described in more detail below. The exemplary reclining mechanism 540 also includes joint 548 configured to engage with a support bar 518 connected to side bars of the frame. Support bar 518 defines a pivot point of the frame. Thus, support bar 518 is configured to rotate within joint 548. By engaging with support bar 518, reclining mechanism 540 provides additional support for the child seat. When the middle bar 516 is engaged with uppermost groove 542, the child seat may be in the most upright orientation. When the middle bar 516 is engaged with lowermost groove 542, the child seat may be in the most reclined orientation. When the middle bar 516 is engaged with groove 542*x*, the child seat may be in the collapsed orientation.

The child seat may include an operating lever 160 operably connected to actuate reclining mechanism 140. The operating lever may be positioned proximate to the reclining mechanism. The operating lever may be positioned remote from the reclining mechanism. In some embodiments, the operating lever may be positioned on a front side of the child seat, for example, adjacent to the frame foot bar, adjacent to a lower end of the frame side bar, or adjacent to the base, for example, the base foot bar 134. In some embodiments, the operating lever may be positioned on a back side of the child seat, for example, adjacent to an upper end of the frame side bar or adjacent to the base.

The operating lever may be designed to be actuated by pushing, pulling, twisting, squeezing, pinching, spreading, or any other application of force. The operating lever may be designed to be actuated with one-handed engagement or two-handed engagement.

Exemplary operating lever 560 is shown in FIGS. 5A-5D. The exemplary operating lever 560 is a pull operating lever. Operating lever 560 sits within the housing of reclining mechanism 540. A portion of operating lever 560 is accessible through an opening in the housing. Operating lever 560 may be actuated by driving the accessible portion with a pulling motion toward base foot bar 534. The accessible portion of operating lever 560 may be actuated with one-handed engagement.

Operating lever 560 is configured to engage with the groove plate comprising grooves 542 through joint 562. In use, actuation of operating lever 560 pivots or slides the groove plate at joint 562 to drive middle bar 516 through channel 544 or allow a user to adjust the child seat by driving middle bar 516 through channel 544, positioning the child seat in a new orientation (see, e.g., FIG. 5D). Spring 564 then drives operating lever 560 back to its initial position, pivoting or sliding groove plate at joint 562 back to its initial conformation, which engages middle bar 516 with the new groove 542.

The child seat may include a locking mechanism. The locking mechanism may be configured to lock the middle bar in at least one of the grooves. In some embodiments, the locking mechanism may be configured to lock the middle bar in each of the plurality of grooves. The locking mechanism may be actuated by the operating lever. The locking mechanism may be resistant to natural movements of the child, such as, bouncing and rocking. Thus, the locking mechanism may generally prevent the child seat from being positioned in a new orientation by natural movements of the child.

In some embodiments, the locking mechanism is provided by an L-shaped groove. The L-shaped groove may comprise a groove channel portion connected to the reclining mechanism channel and a groove locking portion substantially normal to the groove channel portion. An exemplary L-shaped groove is shown in FIG. 5C. In the exemplary L-shaped groove, the short portion of groove 542 is the groove locking portion. As shown in FIG. 5C, groove 542 holds middle bar 516 in the groove locking portion to lock the middle bar 516 in groove 542. Operating lever 560 compresses the spring and pivots or slides the groove plate to drive middle bar 516 out of the groove locking portion and down the groove channel portion. In some embodiments, the groove locking portion may extend downwards from the groove channel portion. In other embodiments, the groove locking portion may extend upwards from the groove channel portion.

Figure 9A:
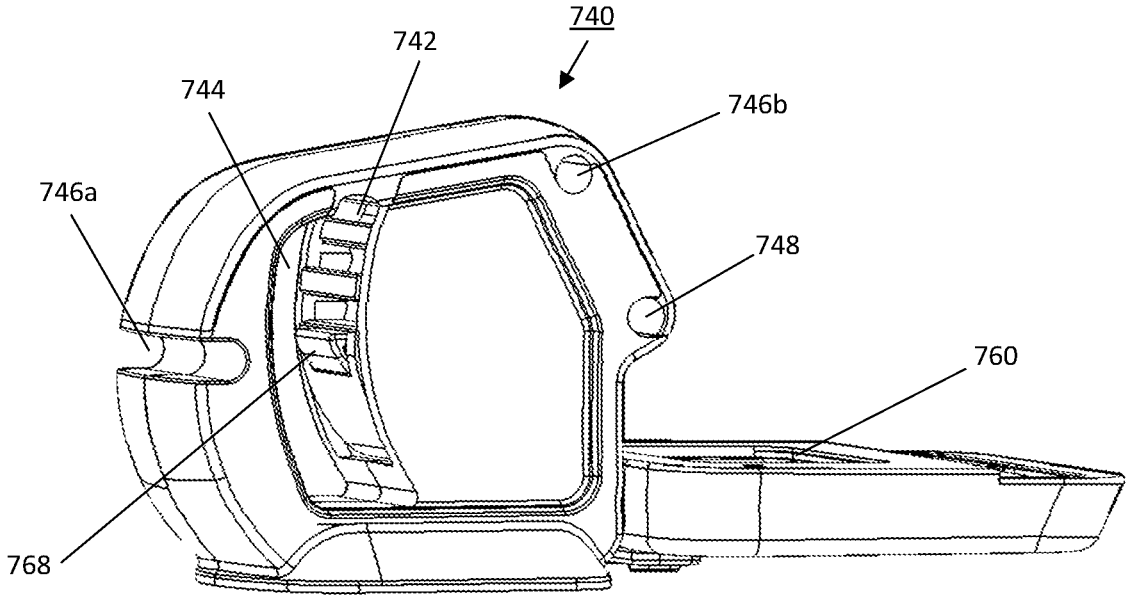
FIG. 9A is a side perspective view of a reclining mechanism, in accordance with one embodiment.
Figure 9B:
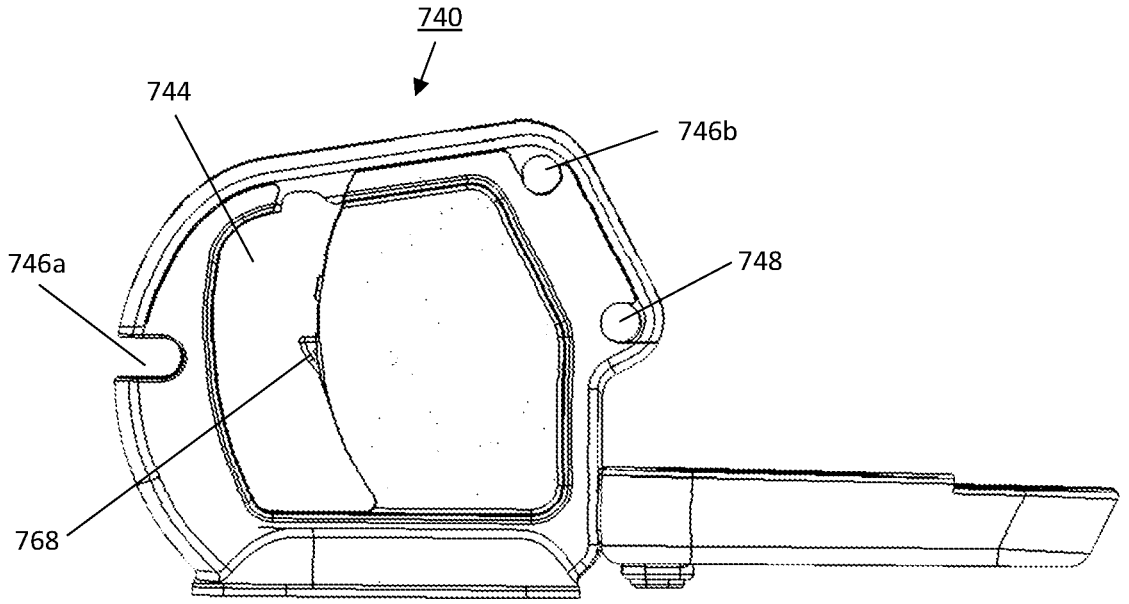
FIG. 9B is a side view of the reclining mechanism of FIG. 9A.
Figure 9C:
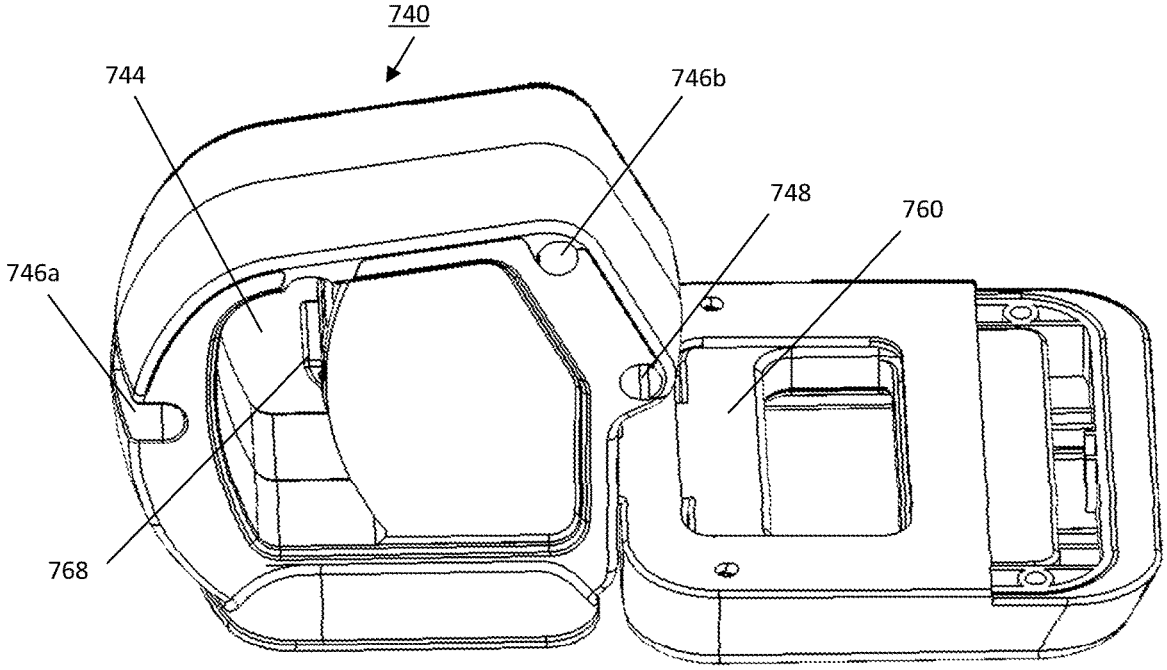
FIG. 9C is a top perspective view of the reclining mechanism of FIG. 9A.

In some embodiments, the locking mechanism may be a safety locking mechanism. The safety locking mechanism may be configured to prevent the child seat from folding into the collapsed orientation. For instance, the safety locking mechanism may be configured to prevent the middle bar from engaging with a groove associated with a collapsed orientation of the child seat. In some embodiments, the safety locking mechanism may be configured to prevent the middle bar from being driven along the channel into a position associated with the collapsed orientation. The safety locking mechanism may comprise a latch (as shown in FIGS. 9A-9C, and described in more detail below). The latch may extend into the channel in a direction generally normal to the middle bar. Thus, the safety locking mechanism may allow the child seat to be transitioned between orientations other than the collapsed orientation. The safety locking mechanism may be actuated by the operating lever (as previously described) or by a safety operating lever configured to allow the child seat to fold into the collapsed orientation.

In certain embodiments, the child seat comprises one or both of the locking mechanism and the safety locking mechanism. In certain embodiments, the child seat comprises one or both of the operating lever and the safety operating lever.

In some embodiments, the locking mechanism and/or safety locking mechanism may comprise a mechanical or electrical locking element. One exemplary mechanical locking element is a spring. In some embodiments, the spring force required to actuate the release mechanism is sufficient to lock the middle bar in the engaged groove. Another exemplary mechanical locking element is a mechanical stopper. The locking mechanism and/or safety locking mechanism may comprise a pressure driver, such as a spring-driven pressure driver. The locking mechanism and/or safety locking mechanism may comprise a retractable bolt, for example, a spring-loaded retractable bolt.

Figure 6A:
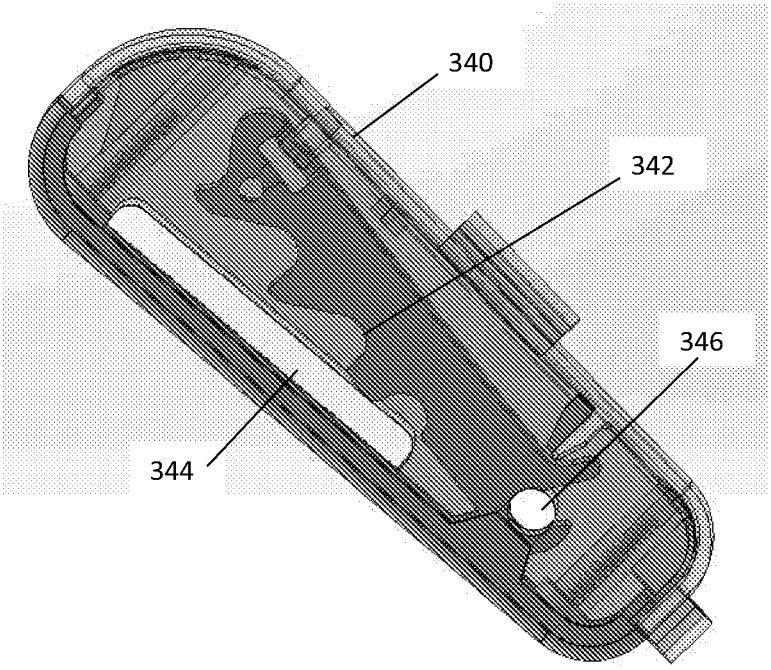
FIG. 6A is a side view of a reclining mechanism in an unlocked conformation, according to one embodiment.
Figure 6B:
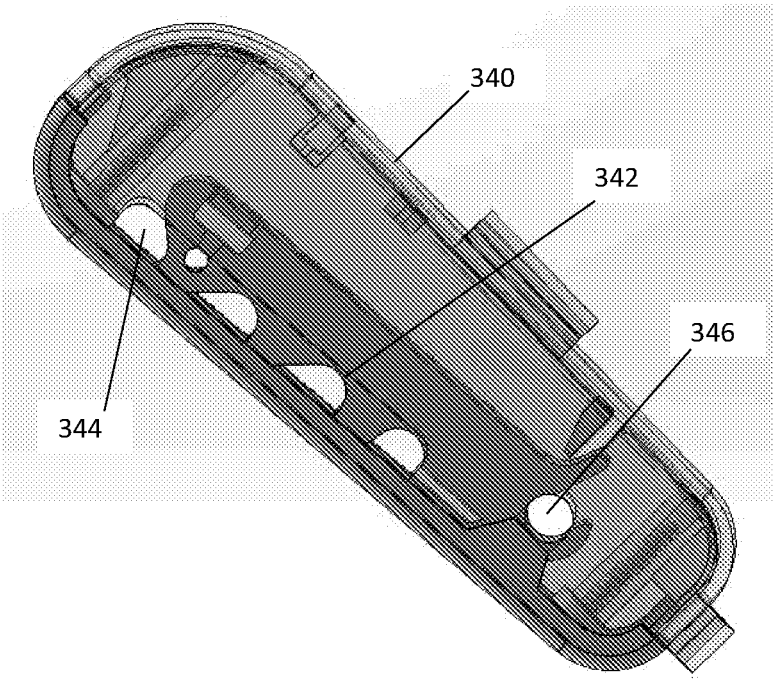
FIG. 6B is a side view of the reclining mechanism of FIG. 6A in a locked conformation

Exemplary reclining mechanism 340 in an unlocked conformation is shown in FIG. 6A. in the unlocked conformation, a groove plate comprising grooves 342 is pivoted to allow middle bar 316 to be driven across channel 344. Accordingly, in the unlocked conformation, the child seat is allowed to be positioned in a new orientation. Exemplary reclining mechanism 340 in a locked conformation is shown in FIG. 6B. In the locked conformation, the groove plate comprising grooves 342 is pivoted to prevent middle bar 316 from being driven across channel 344. Accordingly, in the locked conformation, the child seat is prevented from being positioned in a new orientation. The groove plate may be pivoted by actuation of the operating lever.

Figure 7:
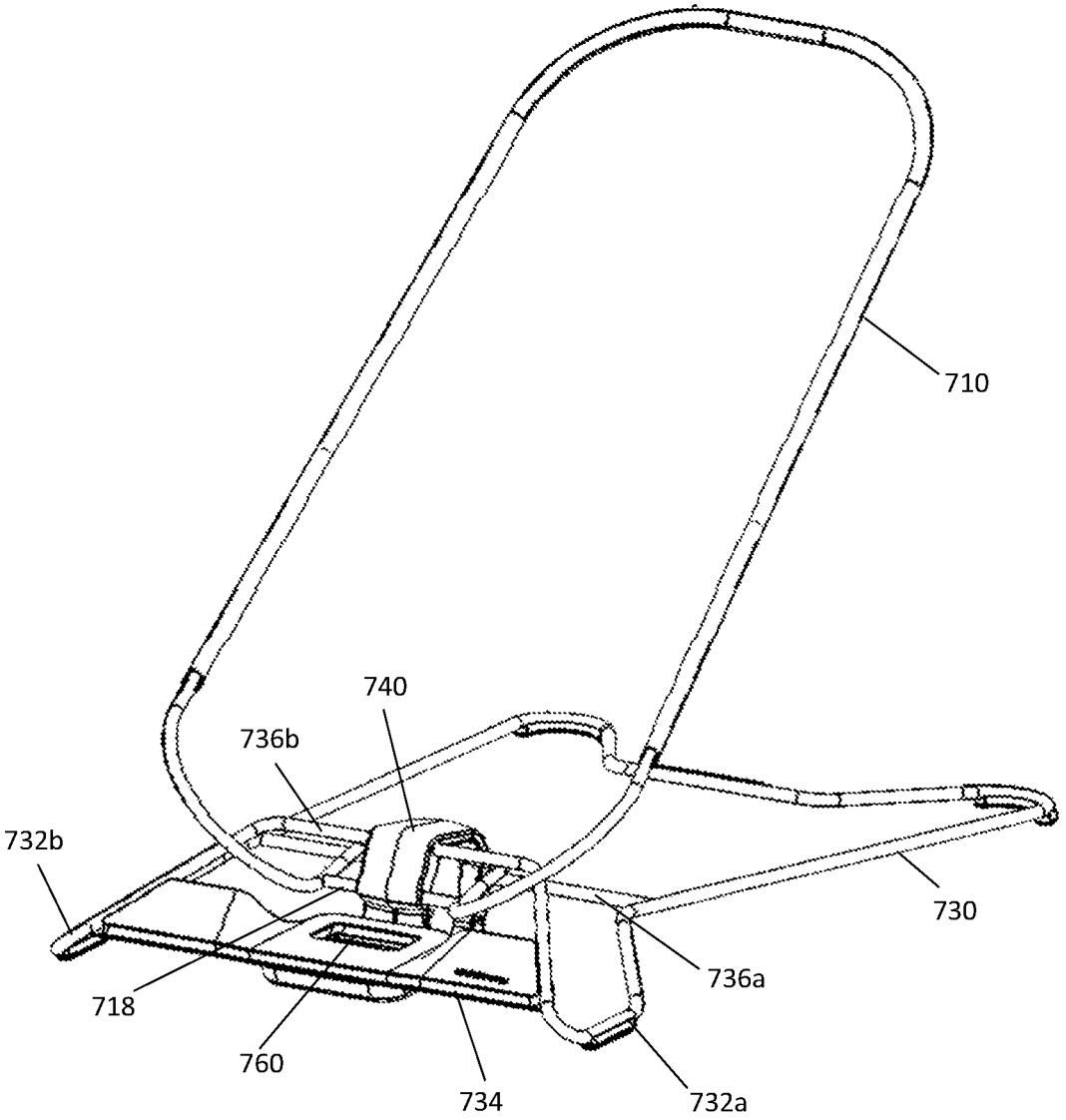
FIG. 7 is a side perspective view of certain components of a foldable child seat, according to one embodiment.

Another exemplary embodiment of a child seat base and frame assembly is shown in FIG. 7. The assembly of FIG. 7 includes frame 710 and base 730 having side bars 732*a*, 732*b* and cross bars 736*a*, 736*b* extending between side bars 732*a*, 732*b*. Frame 710 includes support bar 718 and a middle bar (not visible in the view of FIG. 7), which engage with reclining mechanism 740. The assembly of FIG. 7 also includes foot bar 734 and operating lever 760 accessible through an opening in foot bar 734. As shown in FIG. 7, the base 730 may include a plurality of grips or non-slip surfaces on a bottom facing side to provide support to the child seat.

In some embodiments, the groove plate is a positioner. The positioner may operate similarly to the groove plate shown in FIGS. 5C-5D. For instance, the positioner may define a plurality of grooves. The positioner may pivot or slide to engage the middle bar with each of the grooves. However, the positioner may have a thickness greater than the thickness of the groove plate. The positioner may have a thickness of between about 0.25 in-2.0 in or a thickness substantially equivalent to a width of the interior cavity of the housing, for example, between about 0.25 in-0.5 in, 0.5 in-0.75 in, 0.75 in-1.0 in, 1.0 in-1.5 in, or 1.5 in-2.0 in. The positioner may be capable of pivoting or sliding within the housing with minimal resistance from friction against the side walls of the interior cavity of the housing.

Figure 8A:
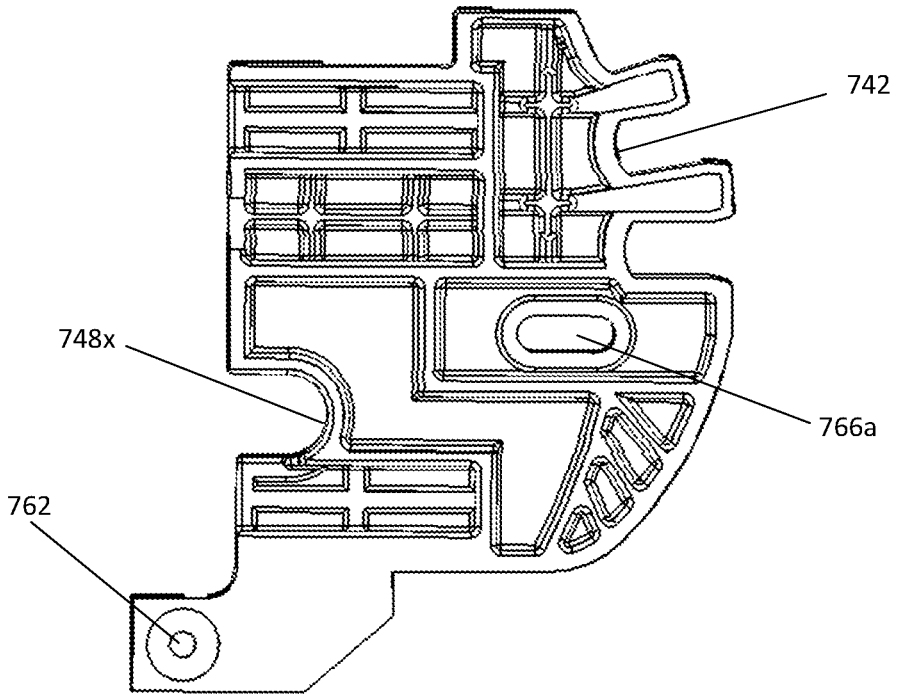
FIG. 8A is a side view of a positioner, in accordance with one embodiment.
Figure 8B:
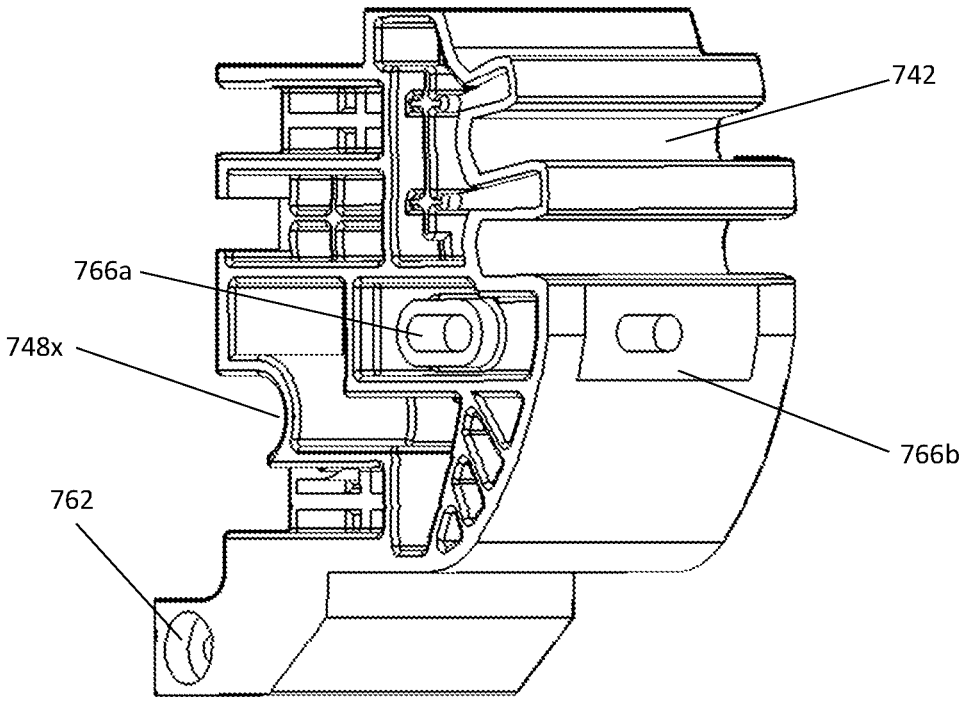
FIG. 8B is a side perspective view of the positioner of FIG. 8A.

One exemplary embodiment of a positioner is shown in FIGS. 8A-8B. The positioner includes grooves 742 configured to engage with the middle bar of frame 710 as the middle bar is driven along channel 744 (shown in FIGS. 9A-9C). The positioner also includes joint 762 configured to engage operating lever 760. Actuation of operating lever 760 pivots or slides the positioner at joint 762 to engage or disengage the middle bar of frame 710 extending through channel 744. The positioner also includes groove 748*x* configured to align with joint 748 (shown in FIGS. 9A-9C) of the housing to engage support bar 718. In use, groove 748*x* is configured to rotate about support bar 718 when the positioner is driven by actuation of operating lever 760.

One exemplary embodiment of a reclining mechanism 740 is shown in FIGS. 9A-9C. Reclining mechanism 740 includes joint 746*a* configured to engage with cross bar 736*a*, joint 746*b* configured to engage with cross bar 736*b*, joint 748 configured to engage with support bar 718, and channel 744. Grooves 742 of the positioner are visible through an opening in the housing of reclining mechanism 740. Latch 768 extends from the positioner (through opening 766*b*) into channel 744, optionally driven by a spring-loaded mechanism. In an engaged position, latch 768 is configured to extend into channel 744 in a direction generally normal to the middle bar, preventing middle bar from being driven across channel 744. In a disengaged position, latch 768 is configured to at least partially retract into the positioner, allowing the middle bar to be driven across channel 744. Reclining mechanism 740 also includes operating lever 760 visible through an opening in the housing.

Thus, the positioner also includes lateral through hole 766*a* and front opening 766*b*. Front opening 766*b* is configured to accommodate latch 768 (shown in FIGS. 9A-9C) while through hole 766*a* is configured to accommodate an optional safety lever of latch 768. Latch 768 and the associated optional safety lever form one embodiment of a safety locking mechanism. Latch 768 may be retractable from an engaged position, extending through front opening 766*b*, to a disengaged position, retracting at least partially into the positioner. When latch 768 is engaged (extending through front opening 766*b*), the middle bar of the frame is prevented from traveling past latch 768 within channel 744, preventing the child seat from folding into the collapsed orientation. Furthermore, in this embodiment, the safety lever being engaged through the through hole 766*a* locks latch 768 in the engaged position against pressure from the middle bar.

Figure 11A:
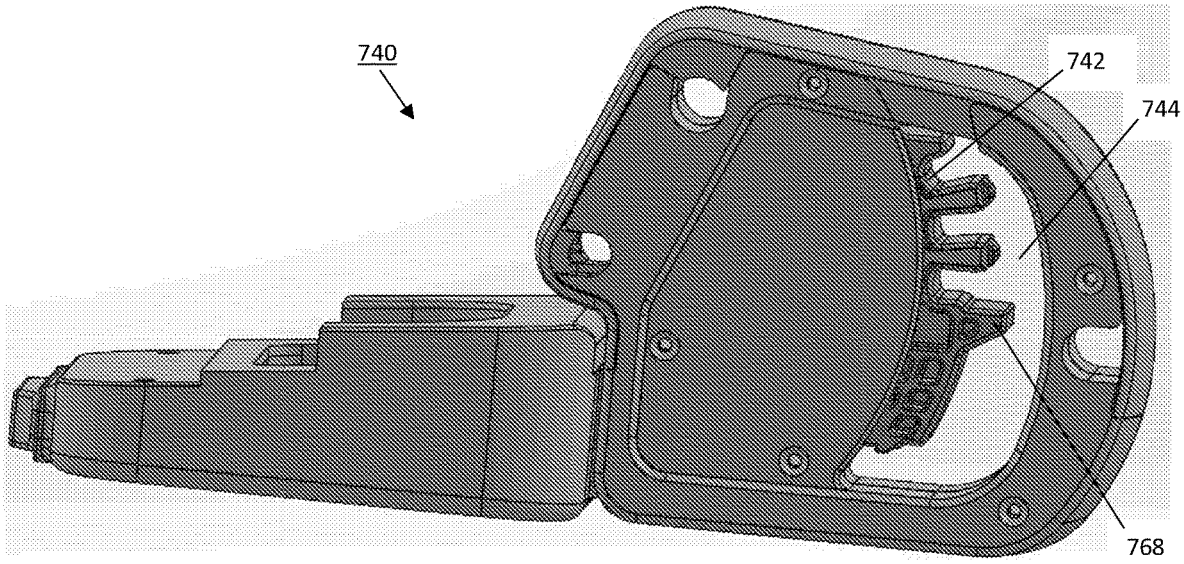
FIG. 11A is a side view of a reclining mechanism, according to one embodiment.

In an alternate embodiment, as shown in FIG. 11A, the positioner includes latch 768. Thus, as shown in FIG. 11A, latch 768 may be a unitary structure with the positioner. Instead of retracting into the positioner, latch 768 is driven by motion of the positioner into and out of channel 744. In an engaged position, the positioner is driven to slide forward, extending latch 768 into channel 744 in a direction generally normal to the middle bar, preventing middle bar from being driven across channel 744. In a disengaged position, the positioner is driven to slide backward, retracting latch 768 at least partially into the housing, allowing the middle bar to be driven across channel 744.

Figure 11B:
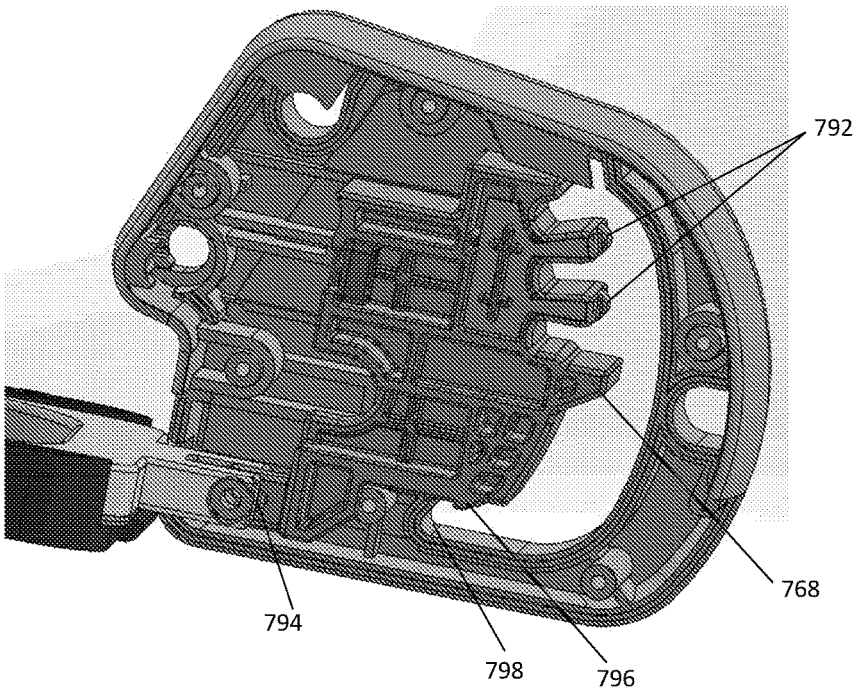
FIG. 11B is a partial perspective view of the reclining mechanism of FIG. 11A, according to one embodiment.
Figure 11C:
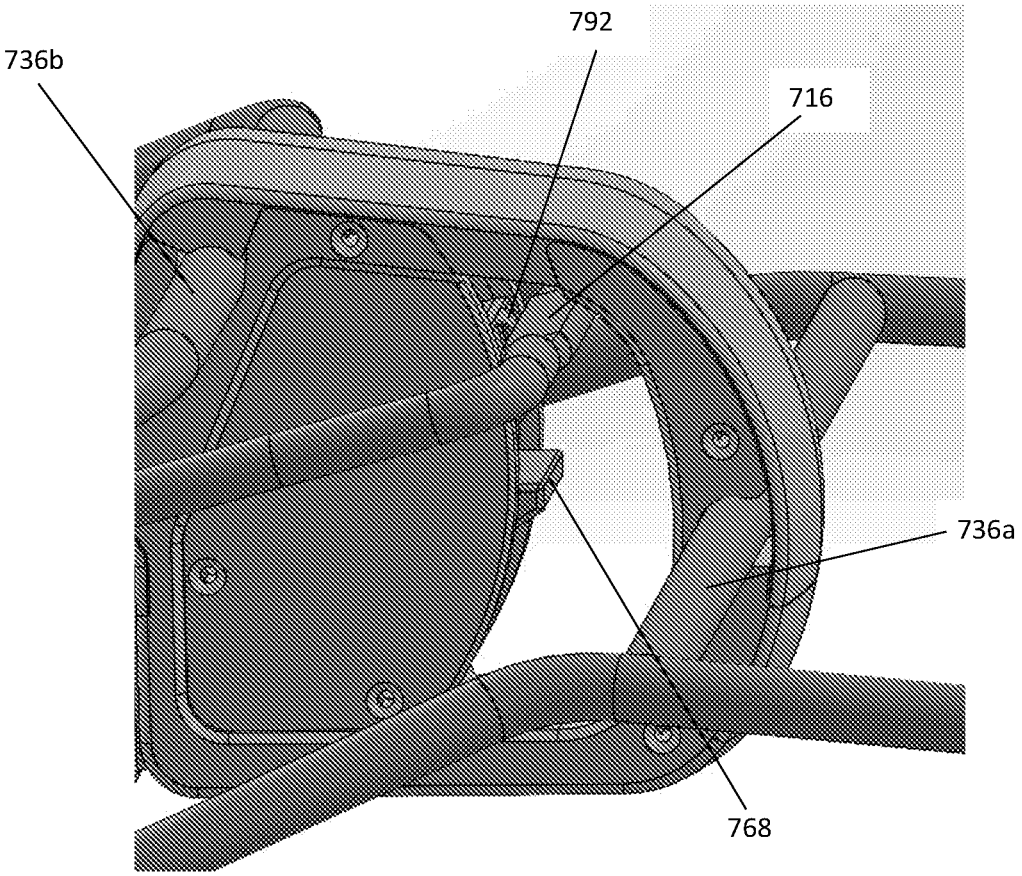
FIG. 11C is a partial view of the reclining mechanism of FIG. 11A engaging the frame, according to one embodiment.

In some embodiments, the positioner may include at least one detent 792 positioned between grooves 742. Exemplary detents 792 are shown in FIGS. 11B-11C. The detents may be mechanical or magnetic structures positioned to engage or contact the middle bar 716 when transitioning between grooves 742. In exemplary embodiments, for example, as shown in FIGS. 11B-11C, the detents 792 may comprise a semi-circular structure, optionally a circular or semi-circular roller. The middle bar 716 may slide over the semi-circular structure to maintain engagement with the positioner. In some embodiments, the semi-circular structure may provide tactile feedback to the operating lever when the middle bar 716 is positioned over the detent 792 and is disengaged from a groove 742. The positioner may also include slot 794 adjacent operating lever joint 762 for operation of detents 792.

The positioner may include a handle stop 796, shown in FIG. 11B, positioned to catch the middle bar in the collapsed orientation. The middle bar may be held between the handle stop 796 and a groove or shelf 798 of the reclining mechanism. The shelf 798 may be formed at an end of channel 744. In some embodiments, the shelf 798 may be positioned on an immobile structure of the reclining mechanism, for example, an interior surface of the housing. In some embodiments, the shelf 798 may be fixed to the housing. In use, the handle stop 796 may catch middle bar between the handle stop 796 and the shelf 798 to lock the child seat in the collapsed orientation. The positioner may be required to lift the handle stop 796 over the middle bar to allow actuation by the operating lever.

Figure 10A:
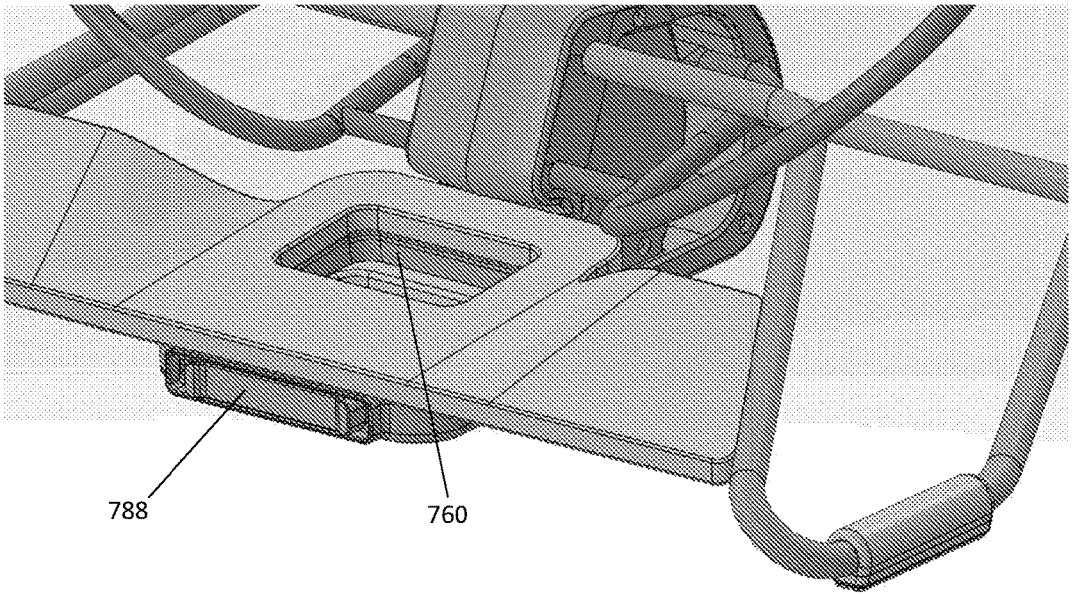
FIG. 10A is a perspective view of a portion of a foldable child seat, according to one embodiment.
Figure 10B:
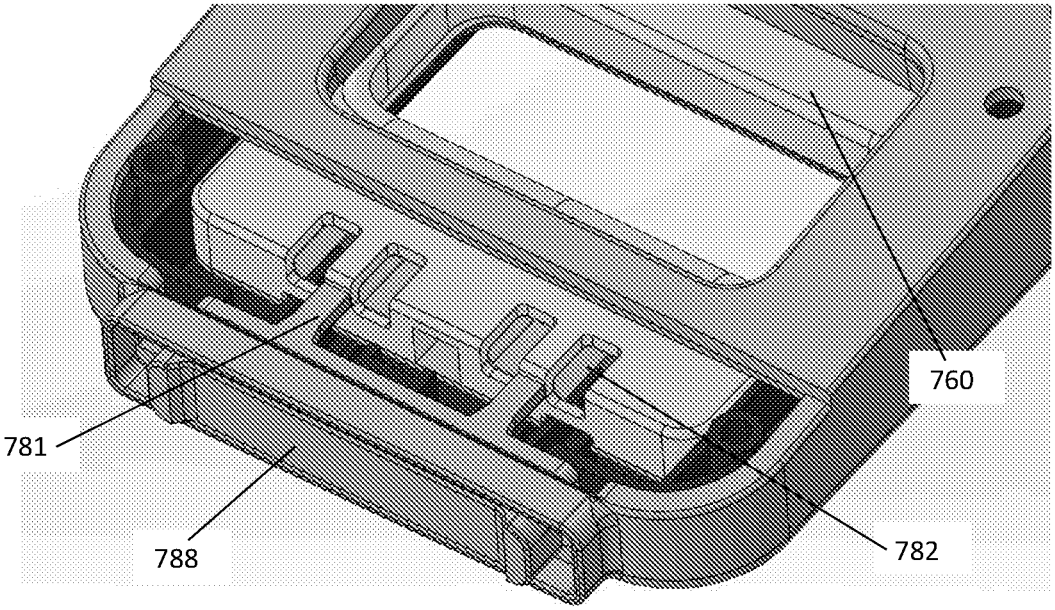
FIG. 10B is a sectional view of the portion of the foldable child seat of FIG. 10A in a first conformation.
Figure 10C:
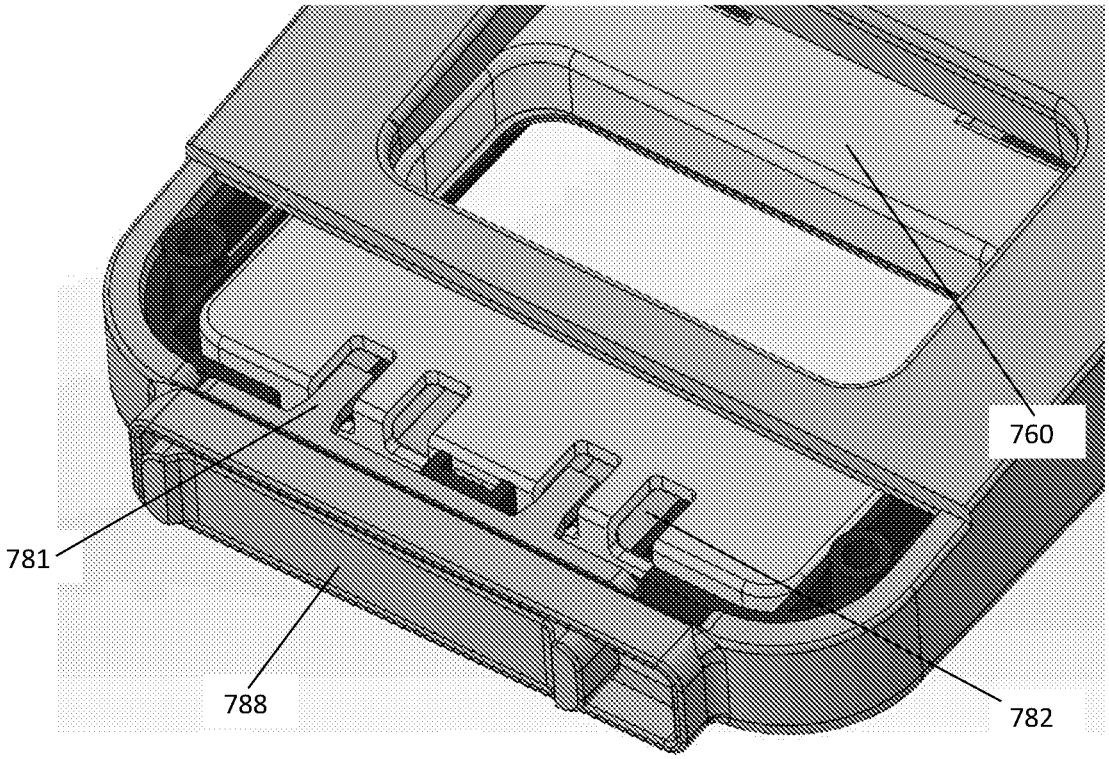
FIG. 10C is a sectional view of the portion of the foldable child seat of FIG. 10A in a second conformation.

One exemplary safety locking mechanism is shown in FIGS. 10A-10C. FIG. 10A is a perspective view of a portion of the child seat showing operating lever 760 and safety locking mechanism 788. Safety locking mechanism 788 is operably connected to operating lever 760. FIGS. 10B-10C are sectional views of the safety locking mechanism 788 operably connected to operating lever 760. In FIG. 10B, safety locking mechanism 788 is in an engaged position (safety lock is on). In the engaged position, the operating lever 760 is prevented from retracting latch 768 into the positioner, but still allowed to drive the middle bar through channel 744 to position the child seat in several orientations which are not the collapsed orientation. In FIG. 10C, safety locking mechanism 788 is in a disengaged position (safety lock is off). In the disengaged position, the operating lever 760 is operable to retract latch 768 into the positioner, allowing the middle bar to travel past latch 768 within channel 744 to fold the child seat into the collapsed orientation. Thus, the safety locking mechanism 788 may be operably connected to lock the operating lever 760 into a position that prevents the middle bar from engaging with the groove associated with the collapsed orientation of the child seat.

As shown in FIGS. 10B-10C, the safety locking mechanism 788 comprises at least one male mating element 781 and the operating lever 760 comprises at least one female mating element 782. In the engaged position (FIG. 10B), the male mating element 781 of safety locking mechanism 788 does not mate with the female mating element 782 of operating lever 760. In the disengaged position (FIG. 10C), the male mating element 781 of safety locking mechanism 788 is allowed to mate with the female mating element 782 of operating lever 760, to enable further range of motion of the operating lever 760. The safety locking mechanism 788 may additionally comprise at least one capture spring that prevents the safety locking mechanism 788 to move into the engaged or disengaged position without voluntary actuation by a user.

The child seat may be configured to bounce. For instance, the child seat may provide a bouncing motion controlled by the child's natural movements. The bouncing motion may be independent from the reclining mechanism. In particular, the bouncing motion may be achieved without actuation of the reclining mechanism. In some embodiments, the bouncing motion may be provided by flexibility of the frame, for instance, flexibility of the side bars.

The child seat may be configured to provide a rocking motion. In some embodiments, the base is curved to provide a rocking motion. In particular, the base side bars may be curved to provide a rocking motion. A child seat having curved base side bars may further comprise a kickstand to inhibit the rocking motion when deployed.

The child seat may comprise a vibrating mechanism for providing a vibration to the child through the flexible material. The vibrating mechanism may be an electronically activated vibrating mechanism. Thus, the vibrating mechanism may comprise a power source or be connectable to a power source.

The disclosure is not limited in its application to the details of construction and the arrangement of components set forth in the following description or illustrated in the drawings. The disclosure is capable of other examples and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional terms.

Having thus described several aspects of at least one embodiment of this disclosure, it is to be appreciated that various alterations, modifications, and improvements will readily occur to those skilled in the art. Such alterations, modifications, and improvements are intended to be part of this disclosure and are intended to be within the spirit and scope of the disclosure. Accordingly, the foregoing description and drawings are by way of example only.

What is claimed is:

1. A foldable child seat comprising:

a frame for supporting a flexible material, wherein the frame comprises a first frame side bar attached to a frame foot bar, and a middle bar attached to the frame foot bar;

a base comprising a first base side bar, a second base side bar, a first cross bar connected to the first base side bar and the second base side bar and a second cross bar connected to the first base side bar and the second base side bar;

a reclining mechanism comprising a portion fixed between the first cross bar and the second cross bar, wherein the reclining mechanism includes at least two grooves configured to engage with the middle bar, one groove being associated with a collapsed orientation of the child seat, a reclining locking mechanism configured to lock the reclining mechanism in at least one of the two grooves, and a safety locking mechanism configured to prevent the middle bar from engaging with the groove associated with the collapsed orientation of the child seat; and an operating lever operably connected to actuate the reclining mechanism.

2. The foldable child seat of claim 1, wherein the operating lever is positioned adjacent a foot bar of the base.

3. The foldable child seat of claim 1, wherein the reclining mechanism is coupled to the first cross bar and to the second cross bar.

4. The foldable child seat of claim 1, wherein the reclining mechanism comprises:

a housing having a first joint configured to engage with the first cross bar and a second joint configured to engage with the second cross bar and a channel, and a spring-loaded positioner comprising the at least two grooves contained within the housing, the middle bar configured to engage with the at least two grooves through the channel.

5. The foldable child seat of claim 4, wherein the safety locking mechanism comprises a latch configured to prevent the middle bar from being driven through the channel into a position associated with the collapsed orientation of the child seat.

6. The foldable child seat of claim 4, wherein the spring-loaded positioner includes at least three grooves, the middle bar being configured to engage with the at least three grooves through the channel.

7. The foldable child seat of claim 4, wherein the operating lever is contained within the housing and accessible to a user by an opening in the housing.

8. The foldable child seat of claim 1, wherein the reclining mechanism includes a positioner comprising the at least two grooves configured to engage with the middle bar.

9. The foldable child seat of claim 8, wherein the operating lever is operably connected to pivot or slide the positioner of the reclining mechanism.

10. The foldable child seat of claim 8, wherein the positioner comprises at least three grooves.

11. The foldable child seat of claim 8, wherein the reclining mechanism includes:

a housing comprising a first joint configured to engage with the first cross bar and a second joint configured to engage with the second cross bar; and the positioner is contained within the housing.

12. The foldable child seat of claim 11, wherein the operating lever is contained within the housing and accessible to a user by an opening in the housing.

13. The foldable child seat of claim 11, wherein the housing comprises a channel, the middle bar being configured to engage with the at least two grooves of the positioner through the channel.

14. The foldable child seat of claim 13, wherein the safety locking mechanism comprises a latch configured to prevent the middle bar from being driven through the channel into a position associated with the collapsed orientation of the child seat.

* * * * *